United States Patent [19]

Beitler et al.

[11] 4,338,061

[45] Jul. 6, 1982

[54] CONTROL MEANS FOR A GAS TURBINE ENGINE

[75] Inventors: Richard S. Beitler; Frederick J. Sellers; George W. Bennett, all of Cincinnati, Ohio

[73] Assignee: The United States of America as represented by the Administrator of the National Aeronautics and Space Administration, Washington, D.C.

[21] Appl. No.: 163,122

[22] Filed: Jun. 26, 1980

[51] Int. Cl.[3] ..... F01D 25/08

[52] U.S. Cl. ..... 415/1; 415/47; 415/175; 415/178

[58] Field of Search ..... 60/39.02, 39.07, 39.29; 415/1, 47, 116, 175, 178

[56] References Cited

U.S. PATENT DOCUMENTS

| | | | |
|---|---|---|---|
| 2,994,472 | 8/1961 | Botje | 415/139 |
| 3,736,751 | 6/1973 | Fuller | 60/262 |
| 3,966,354 | 6/1976 | Patterson | 415/116 |
| 3,975,901 | 8/1976 | Hallinger et al. | 60/39.14 |
| 3,986,720 | 10/1976 | Knudsen et al. | 277/26 |
| 4,005,946 | 2/1977 | Brown et al. | 415/136 |
| 4,019,320 | 4/1977 | Redinger et al. | 60/226 R |
| 4,069,662 | 1/1978 | Redinger et al. | 60/226 R |
| 4,230,436 | 10/1980 | Davison | 415/175 |
| 4,230,439 | 10/1980 | Smith et al. | 415/175 |
| 4,242,042 | 12/1980 | Schwartz | 415/116 |

*Primary Examiner*—Louis J. Casaregola
*Attorney, Agent, or Firm*—Carl L. Silverman; Derek P. Lawrence; Norman T. Musial

[57] ABSTRACT

Clearance control means is provided for a gas turbine engine. In one embodiment relating to compressor blade clearance, means is provided for developing a first signal representative of the actual compressor casing temperature, a second signal representative of compressor inlet gas temperature, and a third signal representative of compressor speed. Schedule means is provided for receiving the gas temperature and compressor speed signals and developing a schedule output signal. The schedule output signal is representative of a reference casing temperature at which a predetermined compressor blade stabilized clearance is provided. Means is provided for comparing the actual compressor casing temperature signal and the reference casing temperature signal and developing a clearance control signal representative of the difference therebetween. The clearance control signal is coupled to a control valve which controls a flow of air to the compressor casing to control the clearance between the compressor blades and the compressor casing. Means is provided for modification of the clearance control signal to accommodate transient characteristics. Other embodiments are disclosed.

12 Claims, 11 Drawing Figures

CONTROL MEANS FOR A GAS TURBINE ENGINE

The invention herein described was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

The present invention relates to a gas turbine engine of the type having rotating blades within a blade casing, and more particularly, to clearance control means for controlling the clearance between the rotating blades and the blade casing.

Modern gas turbine engines typically include a number of blade-to-blade casing interfaces. For example, a typical gas turbine engine for aircraft applications may include the following blade-to-blade casing interfaces: fan blades, compressor blades, high pressure turbine blades, and low pressure turbine blades. The clearance distance between the blades and the blade casings at such interfaces is a critical factor in the performance of such engines.

More particularly, unnecessarily large blade clearances are aerodynamically inefficient while small blade clearances often result in blade rub which may shorten engine life. The wide range of operation of such gas turbine engines, especially aircraft engines, results in significant variation of the clearance as the operating conditions vary. Thus, clearance control techniques have been developed which attempt to deal with this problem.

Although available clearance control techniques are acceptable for certain gas turbine engine applications, the use of such techniques often presents problems. These problems are due, in large part, to the wide range of operating conditions of such engines. In this connection, it is well known that the steady-state clearances of such engines are quite unlike their transient clearances. Thus, it has been found that conveniently available engine parameters, such as compressor speed or gas temperature, are not, by themselves, capable of establishing blade clearance control means which performs well over the wide range of operating conditions of such engines.

Accordingly, it is a general object of this invention to provide improved clearance control means for a gas turbine engine.

Another object of this invention is to provide such clearance control means which employs conveniently available engine parameters.

Another object of this invention is to provide such clearance control means which includes override means for accommodating transient operation.

SUMMARY OF THE INVENTION

In carrying out one form of the invention, we provide clearance control means for a gas turbine engine. The gas turbine engine is of the type including a plurality of radially extending blades rotatably disposed within a relatively stationary blade casing. Means is provided for developing a first signal representative of the actual temperature of the casing. Means is provided for developing a second signal representative of the gas temperature within the casing and proximate to the blades. Means is provided for developing a third signal representative of the rotational speed of the blades. Schedule means is provided for receiving the second and third signals and developing a schedule output signal representative of a reference casing temperature at which a predetermined clearance is provided between the blades and the casing. Means is provided for comparing the first signal and the schedule output signal and developing a clearance control signal representative of the difference therebetween. Valve means is coupled to receive the clearance control signal for controlling an airflow to the casing to control the clearance between the blades and the casing.

DETAILED DESCRIPTION OF THE INVENTION

Figure 1:
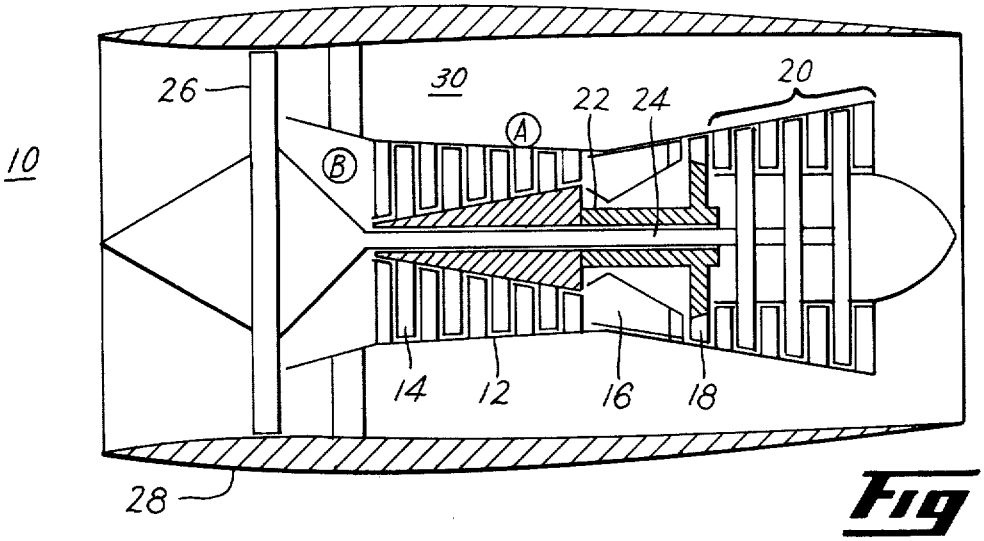
FIG. 1 is a schematic cross section of one form of a gas turbine engine to which the clearance control means of the present invention relates.

Referring to FIG. 1, one form of exemplary gas turbine engine to which the present invention relates is generally designated 10. The engine 10 includes a core engine 12 which includes, in serial flow relationship, an axial flow compressor 14, a combustor 16, and a high pressure turbine 18. The high pressure turbine 18 is drivingly connected to the compressor 14 by a high pressure turbine shaft 22. The engine 10 also includes a low pressure system which includes a low pressure turbine 20. The low pressure turbine 20 is drivingly connected by a low pressure turbine shaft 24 to a fan 26. An outer nacelle 28 is spaced apart from the core engine 12 to define a bypass duct 30 therebetween.

Figure 2:
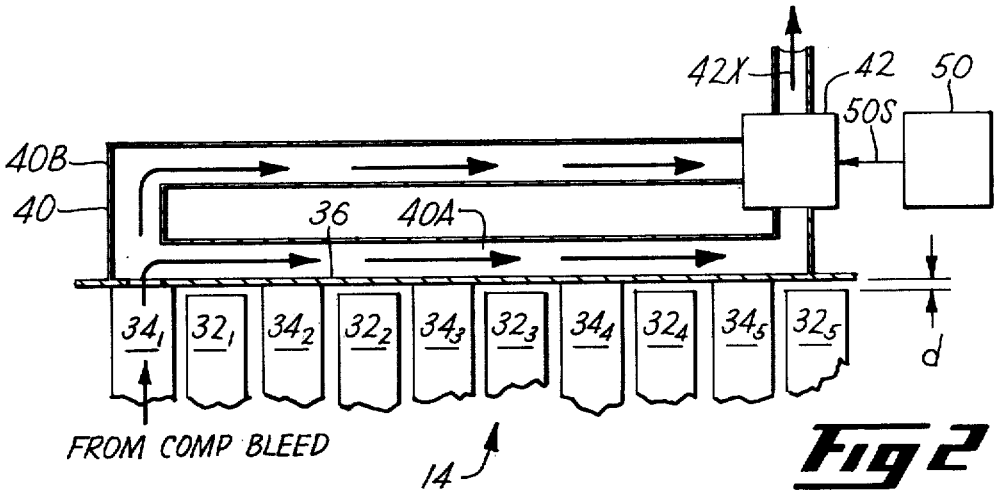
FIG. 2 is a schematic representation of a portion of the compressor section of the gas turbine engine of FIG. 1.

Referring now to FIG. 2, a portion of the compressor 14 of FIG. 1 is shown. More particularly, FIG. 2 is intended to depict the last five stages of an exemplary 10-stage compressor. It is to be appreciated that, for purposes of clarity, the exemplary engine 10 of FIG. 1 is shown with less than five compressor stages. The rotating compressor turbine blade stages of FIG. 2 are represented by the reference numerals $32_1$–$32_5$. Corresponding compressor stator vanes are depicted at $34_1$–$34_5$. The compressor 14 includes an inner casing 36 within which the compressor blades $32_1$–$32_5$ are rotatably disposed. The distance between the edges of the compressor blades 32 and the inside surface of the compressor casing 36 represents the blade clearance d.

A manifold system 40 provides a means for cooling the exterior of the casing 36 using air which may be bled from the compressor for other purposes, such as turbine cooling or control of internal leakage. This flow of cooling air (see arrow) is typically taken from a bleed on the stage 5 compressor (not shown). Manifold 40 receives a flow of cooling air through compressor stator vane $34_1$ and provides two alternate flowpaths for this air, flowpath 40A and bypass flowpath 40B. Flowpath 40A carries the flow of cooling air along the outer side of the casing 36 and then to a clearance control valve 42. The flow of cooling air along the outer side of the casing 36 can be advantageously varied by means of clearance control valve 42 to affect the blade clearance d. The clearance control valve 42 may comprise a conventional airflow valve for controlling the flow of air therethrough. For example, the valve 42 may include an element which provides restriction to flowpaths 40A, 40B. In one exemplary embodiment, the amount of restriction in flowpath 40A varies inversely with the amount of restriction in flowpath 40B. For certain applications, cooling flow output 42X of clearance control valve 42 may be used for purposes other than clearance control, e.g., for purging purposes. Further information on an exemplary manifold system for clearance control can be found in copending application of Ser. No. 60,449, filed July 25, 1979, entitled "Active Clearance Control System For a Turbomachine," and assigned to the assignee of the present application.

Figure 3:
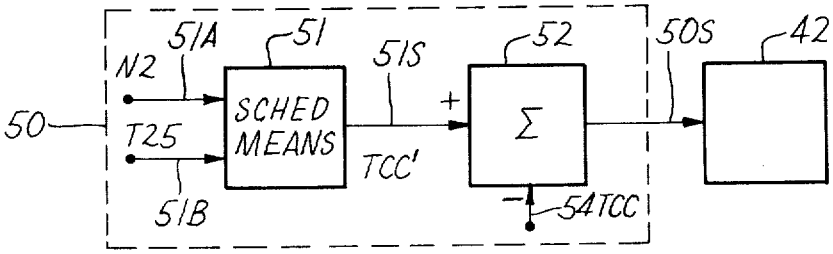
FIG. 3 is a functional block diagram showing one form of clearance control means of the present invention.

In one form of the present invention, clearance control means 50 is provided for developing a desirable control valve signal 50S for operating the clearance control airflow valve 42. Referring now to FIG. 3, one form of the clearance control means 50 of FIG. 2 is shown in further detail.

In the control means 50 of FIG. 3, the clearance control signal 50S is representative of the difference between the actual temperature of the compressor casing 36, designated TCC, and a reference casing temperature, designated TCC′, at which a predetermined blade clearance d is known to exist at stabilized conditions. More particularly, schedule means 51 is provided to receive a first signal 51A representative of a gas temperature, designated T25, within the casing 36 and proximate to the blades 32, and a second signal 51B representative of the core, or compressor rotational speed, designated N2. The schedule means 51 processes these input signals and then develops, in a manner which will be explained more fully later, a schedule output signal 51S representative of a reference casing temperature TCC′ at which a predetermined stabilized clearance d is provided. Comparator means 52 is coupled to receive the schedule output signal 51S, representative of the reference casing temperature TCC′, and a second signal 54, representative of the actual temperature of the compressor casing, designated TCC. The comparator 52 then develops an output signal 50S which is representative of the difference between the actual temperature of the casing TCC, and the reference casing temperature TCC′. The output signal of the comparator 52 represents the control signal 50S to the clearance control valve 42, as shown in FIG. 2. As will be discussed more fully later, for certain applications the control signal 50S may be further processed and then coupled to the valve 42.

It is to be appreciated that the signals representative of compressor speed N2 and compressor inlet temperature T25 are commonly employed signals for aircraft engine applications. More particularly, compressor speed N2 is simply obtained through an electromagnetic rotary motion sensing device. Compressor inlet and compressor casing temperatures, T25, TCC, respectively, may be simply obtained through electrical resistance thermometers or temperature sensing devices, such as the ones often employed in developmental testing of gas turbine engines.

Exemplary locations for sensing the compressor casing temperature TCC and the gas temperature T25 are shown in FIG. 1 at points A, B, respectively. It has been found that a combination of the three previously noted variables, i.e., compressor rotational speed N2, inlet air temperature T25, and compressor casing temperature TCC, provides an excellent means to provide an indication of stabilized clearance d from which a desirable casing cooling air schedule may be conveniently provided. In order to appreciate the operation of the clearance control means of the present invention, it is helpful to refer to FIGS. 4–7, which Figures depict a number of important relationships.

Figure 4:
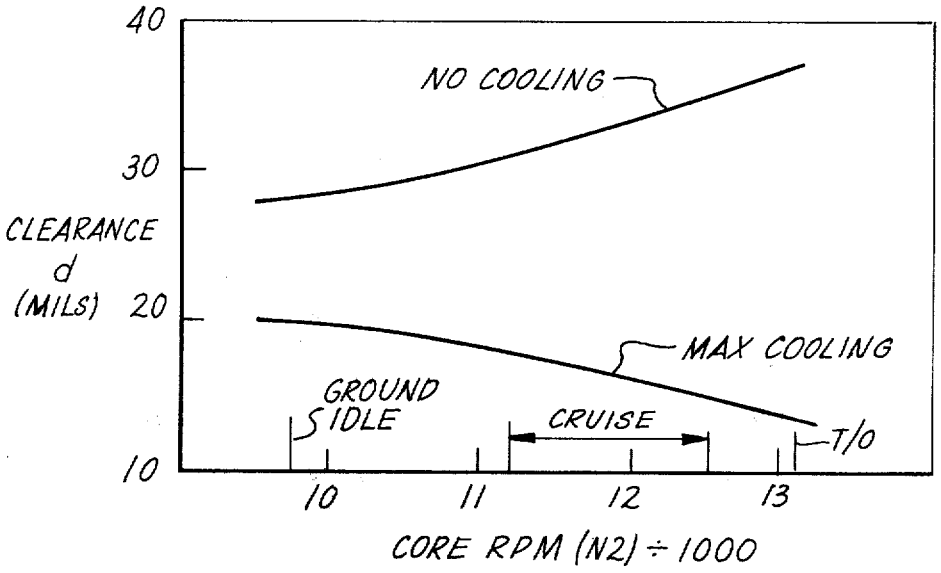
FIG. 4 is a graph showing the manner in which clearance d varies with core or compressor speed N2 for the case in which no cooling flow is provided and for the case in which maximum cooling flow is provided.
Figure 5:
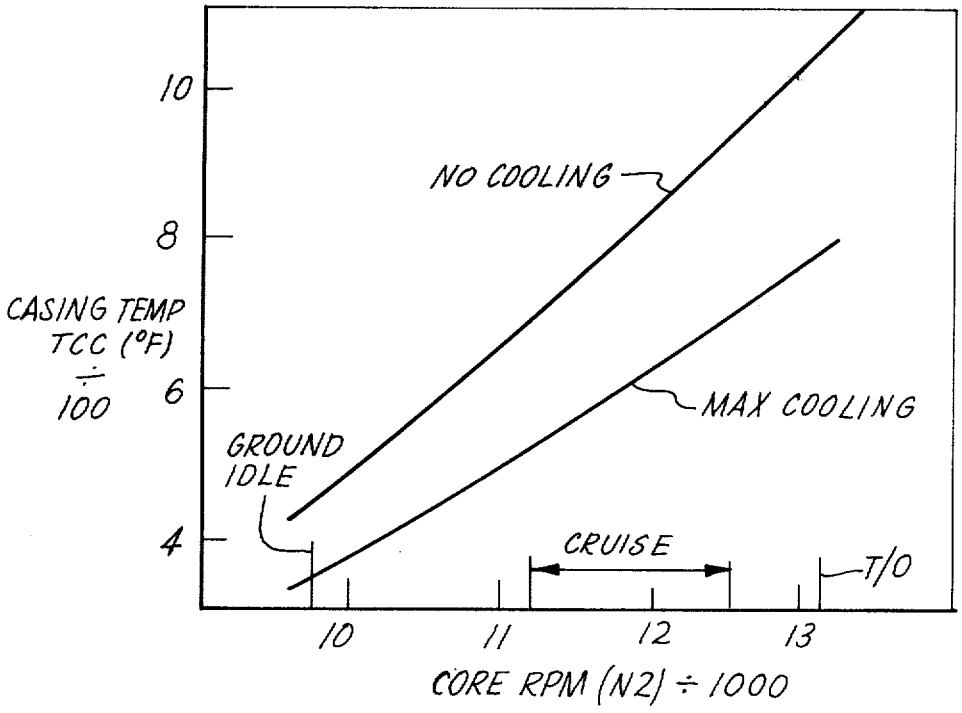
FIG. 5 is a graph showing the manner in which compressor case temperature TCC varies as a function of core speed N2 for the case in which no cooling flow is provided and for the case in which a maximum cooling flow is provided.
Figure 6:
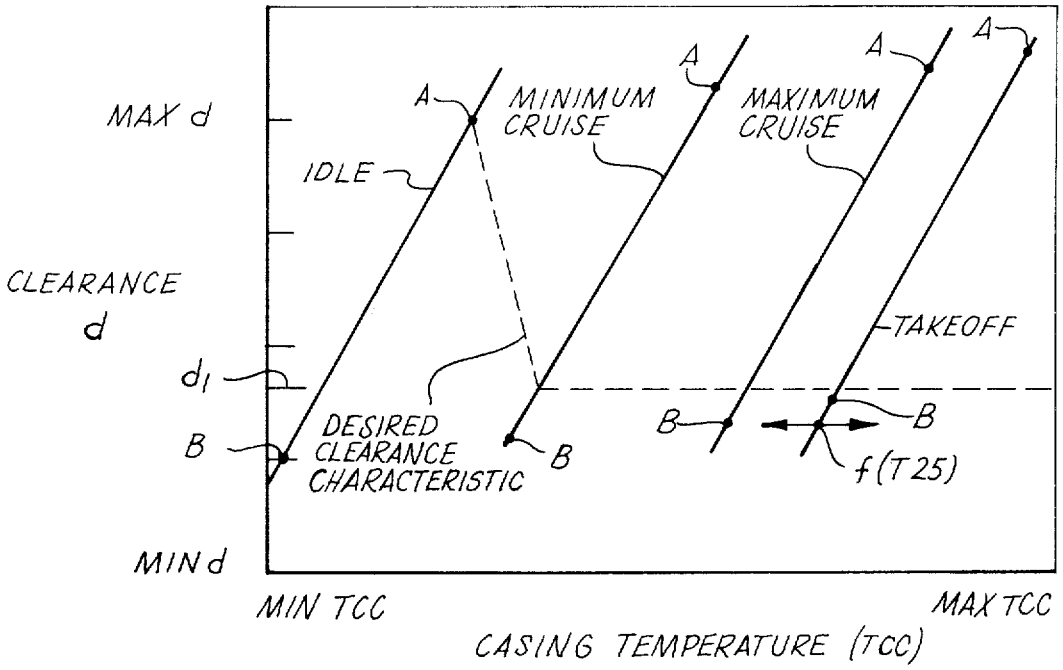
FIG. 6 is a graph showing the manner in which clearance d varies with casing temperature TCC, core speed N2, cooling flow, and gas inlet temperature T25 for various engine operating points.

Referring initially to FIG. 4, blade clearance d is shown as a function of core speed N2 for both cooling and no-cooling of the compressor casing 36. FIG. 5 shows the relationship between compressor casing temperature TCC and core speed N2 for the no-cooling and cooling cases. FIG. 6 represents a combination of the graphs of FIGS. 4 and 5, showing clearance d as a function of casing temperature TCC, core speed N2, and gas temperature T25.

Referring now more particularly to the graph of FIG. 6, clearance d is shown as a function of compressor casing temperature TCC for a number of operating points, including: idle, minimum cruise, maximum cruise, and takeoff.

Referring to the idle speed relationship, point A thereon represents a minimum cooling flow while opposing point B represents a maximum cooling flow. Thus, at idle speed conditions, increasing the cooling flow through clearance control valve 42 from a minimum to a maximum causes the clearance d to vary from a maximum value toward a minimum value while, at the same time, the casing temperature TCC changes in a predetermined manner. This variation of casing temperature TCC in such a predetermined manner, is utilized, in accordance with the present invention, to provide the desired clearance d for various operating points. For example, referring now to the takeoff point of operation, any given clearance d is provided when the casing temperature TCC varies between the minimum cooling point A and the maximum cooling point B.

Thus, the casing temperature TCC, in combination with the core speed N2, may be employed to schedule a continuous range of desirable operating blade clearances d. More particularly, it is often desirable to provide a minimum operating clearance $d_1$ for takeoff, and for cruise operation where most of the aircraft engine flight time is accumulated, while providing for increased clearances at power operations below a predetermined minimum cruise so as to reduce the potential for rotor rubs upon subsequent acceleration. Thus, a schedule, such as the one shown in dashed lines in FIG. 6, can be provided to set a desired clearance characteristic. The operating lines of FIG. 6 also vary as a function of gas temperature, e.g., T25. More particularly, increased gas temperatures cause each of the operating lines to shift to the right while lowered gas temperatures cause each of the operating lines to shift to the left, as shown for the takeoff operating line.

Figure 7:
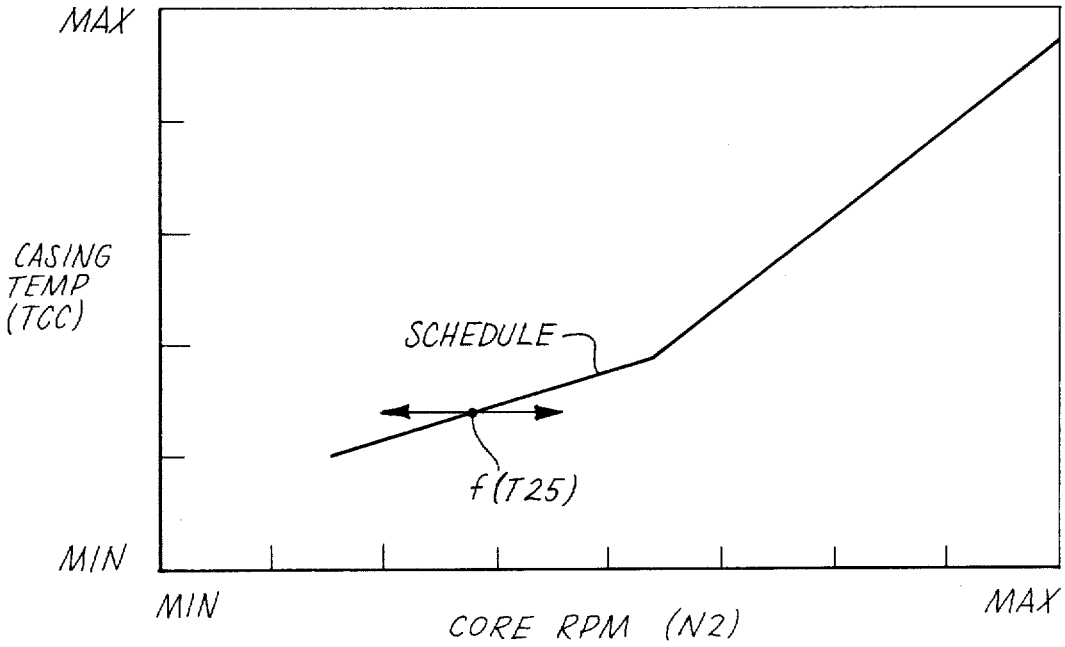
FIG. 7 is a graph showing compressor casing temperature TCC as a function of core speed N2 and gas inlet temperature T25.

Referring now to FIG. 7, compressor casing temperature TCC is shown as a function of core speed N2 and gas inlet temperature T25. It is to be appreciated that the curve of FIG. 7 represents a compressor casing temperature schedule which is utilized, in accordance with the present invention, to operate the clearance airflow control valve 42 of FIGS. 2 and 3. More particularly, the compressor casing temperature TCC shown in the ordinate, as a function of T25, corresponds to the schedule output signal 51S of FIG. 3 and is representative of a reference casing temperature TCC' at which the predetermined clearance d is provided over a full speed range N2 of engine operation.

For some applications, the casing temperature schedule may be modified. For example, the casing temperature schedule may include an altitude modifier which senses altitude pressure in a conventional manner and then adjusts the schedule to provide desirable clearances. More particularly, the minimum clearance may be established in the flight regimes where most flight time is accumulated while increased clearances are established elsewhere to provide additional rub avoidance margin for transients and flight maneuvers.

It is to be appreciated that, although the characteristics depicted in FIGS. 4–7 apply to a gas turbine compressor section, other rotor/stator combinations, e.g., low pressure and high pressure turbine sections, exhibit similar characteristics.

Figure 8:
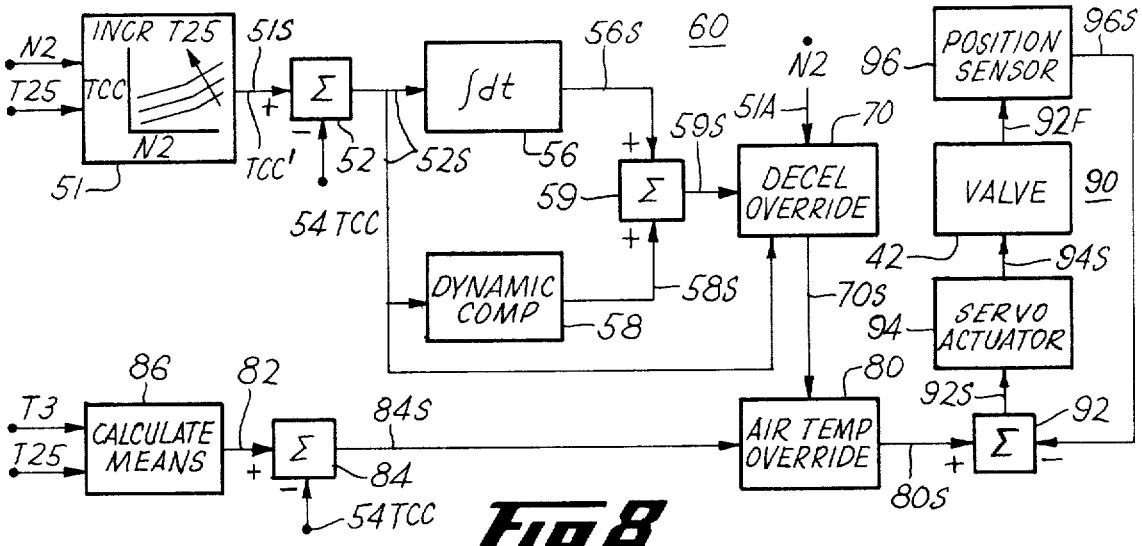
FIG. 8 is a functional block diagram, similar to FIG. 3, showing further details of one clearance control means of the present invention.

Referring now to FIG. 8, the form of control means shown in FIG. 3 is shown in more detail and is generally designated 60. The control means 60 of FIG. 8 is similar in many respects to the control means 50 of FIG. 3 so that, wherever possible, like reference numerals have been employed to represent like elements.

Schedule means 51 is provided to receive input signals representative of core speed and gas inlet temperature. The schedule means 51 functions as previously explained with regard to FIGS. 4–7 to develop a reference output signal 51S. As noted previously, the schedule output signal 51S represents a reference casing temperature TCC' at which a predetermined clearance d is provided. Comparator 52 is coupled to receive the schedule output signal 51S and a signal 54 representative of the actual compressor casing temperature. The comparator 52 develops an output signal 52S representative of the difference between the signals 51S and 54 and may be referred to as the temperature casing error signal 52S. This error signal 52S corresponds to the clearance control valve signal 50S of FIG. 3.

The temperature casing error signal 52S is coupled to a control and stabilization network comprising time integrator means 56, dynamic compensation or multiplier means 58, and summation means 59. This network provides a conventional proportional plus integral control action between casing error signal 52S and summation output signal 59S. Thus, summation means 59 develops an output signal 59S representative of the sum of a time integrated error signal 56S and a dynamically compensated error signal 58S. For many engine applications, summation output signal 59S may be employed to operate the control valve 42 for controlling the flow of cooling air to the casing 36.

Control means 60 further includes override means for satisfying additional transient needs. More particularly, deceleration override means 70 is provided in order to avoid rubs if the engine is re-accelerated before the rotors cool to their stabilized temperature level. The deceleration override means 70 receives the integrated and dynamically compensated summation output signal 59S as well as the temperature error signal 52S. The deceleration override means 70 also receives a signal 51A representative of the rate of change of compressor core speed, designated N2. The override means 70 functions to develop an output signal 70S which operates to cause the clearance control valve 42 to reduce, e.g., cut off, the casing cooling flow when the compressor rotor decelerates and to keep it cut off until the temperature of the compressor casing decreases to a level equal to the scheduled level plus a predetermined differential which accounts for the absence of cooling, or the engine re-accelerates. Under other conditions, the deceleration override means 70 does not affect the summation output signal 59S.

Another override means 80 may be provided to accommodate the transient feature in which, after an acceleration, the casing cooling air may be warmer than the casing. When this transient condition occurs, the override means 80 functions to develop an output signal 80S which causes the control valve 42 to remain on. Thus, in this case, the air, which is now heating air, is turned on to increase the clearance temporarily for transient rub avoidance. This is accomplished by comparing the actual temperature of the compressor casing TCC, signal 54, with a signal 82 representative of the temperature of the cooling airflow. This comparison may be made through comparator means 84 which develops comparator means output signal 84S which is coupled to the override means 80. The cooling airflow temperature signal 82 may, for example, be developed through calculating means 86 which receives as input signals thereto, signals representative of T3 and T25, which represent compressor discharge and compressor inlet air temperatures, respectively. Thus, override means 80 develops an on, or, open signal 80S for causing the control valve 42 to be on or open whenever the temperature of the cooling airflow is greater than the temperature of the compressor casing. During other times, the override means 80 does not affect the information provided by the summation output signal 59S.

The output signal 80S of override means 80 may be coupled to a position control loop 90, as shown in FIG. 8. The position control loop 90 may, for example, comprise feedback comparator 92, servo actuator 94, clearance control airflow valve 42, and position sensor 96. More particularly, feedback comparator means 92 receives the output signal 80S and develops its output signal 92S which is fed to valve servo actuator 94. The output 94S of the valve servo actuator 94 operates the air control valve 42. It is to be appreciated that the output 94S of the servo actuator 94 is similar to the clearance control signal 50S of FIGS. 2 and 3. A feedback valve position signal 92F is developed at or near the air control valve 42 and is coupled to a position sensor 96. The position sensor 96 develops a position sensor output signal 96S which is coupled into the feedback comparator means 92, thus providing feedback control of the air control valve 42.

An important advantage of the present invention is that the casing temperature responds relatively slowly to changes in engine operating condition. This characteristic is desirable in that it reduces the likelihood of transient rubs. Indeed, when an acceleration is made, the casing takes several minutes to reach a stabilized temperature condition. During much of this stabilization period, the casing temperature will be less than the scheduled casing temperature so that the schedule will cause the cooling air to shut off. This feature provides temporary clearance increases which help avoid rotor rubs during maneuvers such as aircraft takeoff or climb initiation rotation which frequently follow an engine acceleration.

Although the clearance control means of the present invention has been described with regard to rotating blades in a compressor section, the control means is generally applicable to any rotating blade disposed within a relatively stationary blade casing. Further, the blade casing may comprise a casing, as previously described, or may comprise an intermediate structure which is itself mechanically coupled to a casing. For example, the relatively stationary blade casing may comprise blade shrouds coupled to a casing.

Figure 9:
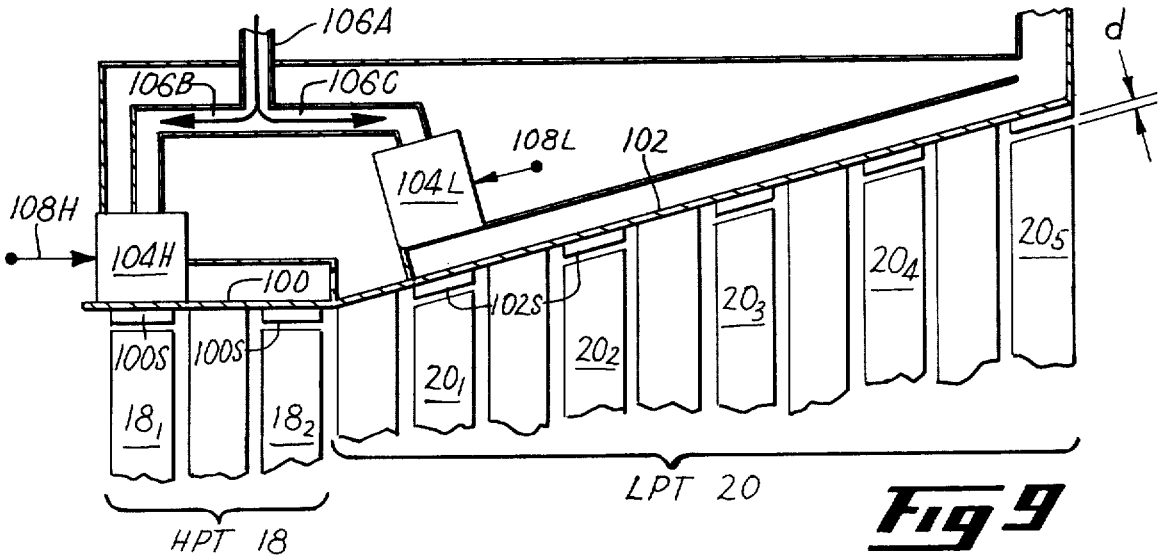
FIG. 9 is a schematic representation of a portion of the high pressure and low pressure turbine sections of the gas turbine engine of FIG. 1.

Referring now to FIG. 9, a portion of the high and low pressure turbine sections of FIG. 1 are shown. The high pressure turbine 18 is shown as comprising a double stage turbine and the low pressure turbine 20 is shown as comprising a 5-stage turbine. Thus, high pressure turbine blades $\mathbf{18}_1$, $\mathbf{18}_2$ and low pressure turbine blades $\mathbf{20}_1$-$\mathbf{20}_5$ are shown. The casing of the high pressure turbine is shown at 100 while the casing of the low pressure turbine is shown at 102. Shrouds 100S, 102S are respectively coupled to the casings 100, 102 such that their position with respect to the blade edges is determined by the position of the casings 100, 102 with respect to the blade edges. The clearance between the rotating blades and the shrouds is represented by d. Valve control means 104H and 104L separately control the flow of cooling air, e.g., fan air, to high pressure turbine casing 100 and low pressure turbine casing 102. Valves 104H and 104L are similar to the clearance control valve 42 of FIG. 3. Cooling air, e.g., fan air, is communicated through a conduit 106A and branch conduits 106B and 106C to the separate control valves 104H and 104L.

In accordance with one form of the present invention, the valves 104H and 104L of FIG. 9 are provided with clearance control valve signals 108H and 108L, respectively.

Figure 10:
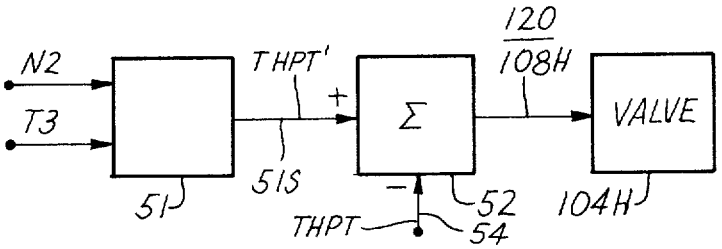
FIGS. 10 and 11 are functional block diagrams, similar to FIG. 3, showing forms of clearance control means of the present invention employed in connection with a high pressure turbine, and a low pressure turbine, respectively.

Referring now to FIG. 10, one form of control means for the high pressure turbine clearance control is generally designated 120. The control means 120 includes schedule means 51, similar to the previously described schedule means, which receives input signals representative of speed and gas temperature. For example, compressor speed N2 and compressor discharge temperature T3 may be employed. The schedule means 51 then develops its schedule output signal 51S which is representative of the reference high pressure turbine casing temperature THPT' at which a predetermined stabilized clearance is provided. Comparator means 52 receives the reference casing temperature signal 51S and an actual turbine casing temperature THPT, signal 54, and develops an output signal 108H representative of the difference therebetween, as in the control means 50 of FIG. 3.

Figure 11:
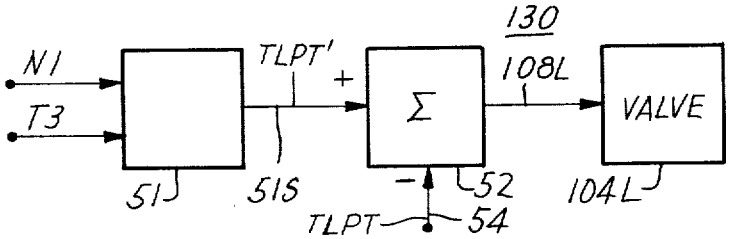

Referring now to FIG. 11, control means for controlling the clearance in the low pressure turbine 20 is generally designated 130 and is similar to the control means of FIGS. 3 and 10 except that a number of inputs are changed. More particularly, control means 130 receives signals representative of low pressure turbine speeds, e.g., N1, and gas temperature, e.g., T3, to develop a reference low pressure turbine casing temperature 51S at which the predetermined clearance is provided. The control means 130 then compares the reference low pressure turbine casing temperature TLPT', signal 51S, with the actual low pressure turbine casing temperature TLPT, signal 54, to develop the control signal 108L.

It is to be appreciated that the previous discussion of the compressor clearance control means of the present invention is also applicable to both the high pressure turbine control means and the low pressure control means.

An important advantage of the clearance control means of the present invention is that the control of casing temperature provides a desirable clearance control characteristic over a wide range of operating conditions. In this connection, the use of casing temperature has been found to be more closely related to clearance than previously employed parameters.

It is generally desirable that the variable parameters employed in the control means of the present invention be directed to the blade clearances to be controlled. For example, it is generally desirable that the gas temperature parameter input be taken at a point proximate to the blades involved. In this connection, by the term proximate, it is meant a point in the engine internal flowpath closely related to the temperature of the rotor and blades involved.

As suggested above, for some applications, it may be desirable to select representational values of the various parameters needed in the control means of the present invention. More particularly, for purposes of convenience, it may be desirable to employ the core speed N2 as a speed parameter even when dealing with the high pressure turbine section. Similarly, it may be desirable to employ the compressor discharge temperature when dealing with clearance control of the high pressure turbine. In some cases, however, in order to employ such conveniences, it may be necessary to adjust the predetermined schedule to account for the fact that the parameters are not taken at the precise point at which the clearance of particular blades is involved. In this connection, the exemplary two-stage high pressure turbine 18 of FIG. 9 is shown as being controlled through a single control valve 104H. This may be accomplished by a single set of input parameters, as described previously. Similarly, the exemplary 5-stage low pressure turbine 20 may also use any convenient speed and temperature parameters and such parameters may be taken from convenient locations. However, as mentioned previously, it may be necessary, in some applications, to provide the necessary adjustments to the predetermined schedule so as to compensate for the fact that the parameters are not sensed at the point at which the clearance is to be controlled. Further, it is to be recognized that, where desired, the present invention may include a separate clearance control measurement and control for each stage of any of these rotating blade sections.

As used in this application, the term signal may denote physical indicia such as mechanical linkage movement, or the like, or electrical indicia such as voltage and/or current.

While the present invention has been described with reference to specific embodiments thereof, it will be obvious to those skilled in the art that various changes and modifications may be made without departing from the invention in its broader aspects. It is contemplated in the appended claims to cover all such variations and modifications of the invention which come within the true spirit and scope of our invention.

What is claimed as new and desired to be secured by Letters Patent of the United States is:

1. In a gas turbine engine of the type including a plurality of radially extending blades rotatably disposed within a relatively stationary blade casing and including clearance control means for controlling an airflow to the casing to control the clearance between the blades and the casing, wherein the clearance control means comprises:

(a) means for developing a first signal representative of the actual temperature of said casing;

(b) means for developing a second signal representative of the gas temperature within said casing and proximate to said blades;

(c) means for developing a third signal representative of the rotational speed of said blades;

(d) schedule means for receiving said second and third signals and developing a schedule output signal representative of a reference casing temperature at which a predetermined clearance is provided;

(e) means for comparing said first signal and said schedule output signal and developing a clearance control signal representative of the difference therebetween; and (f) valve means coupled to receive said clearance control signal for controlling said airflow to said casing.

2. Clearance control means in accordance with claim 1 in which the engine includes a compressor section, said blades comprise compressor blades and said casing comprises a compressor casing.

3. Clearance control means in accordance with claim 2 in which said first signal is representative of the actual temperature of said compressor casing and said third signal is representative of compressor blade speed.

4. Clearance control means in accordance with claim 3 in which said second signal is representative of compressor inlet temperature.

5. Clearance control means in accordance with claim 2 which includes override means for accommodating for transient operation of the engine.

6. Clearance control means in accordance with claim 5 in which said override means includes deceleration override means responsive to compressor speed for causing said valve means to reduce said airflow to said casing when a predetermined deceleration occurs.

7. Clearance control means in accordance with claim 5 in which said override means includes air temperature override means responsive to the temperature of said airflow for causing said valve means to increase said airflow to said casing when said airflow temperature exceeds the actual temperature of said compressor casing.

8. Clearance control means in accordance with claim 1 in which the engine includes a high pressure turbine section, said blades comprise high pressure turbine blades and said casing comprises a high pressure turbine casing.

9. Clearance control means in accordance with claim 1 in which the engine includes a low pressure turbine section, said blades comprise low pressure turbine blades and said casing comprises a low pressure turbine casing.

10. Clearance control means in accordance with claims 8 or 9 which includes transient override means for accommodating for transient operation of the engine.

11. Clearance control means in accordance with claim 1 in which the engine comprises an aircraft engine.

12. In a gas turbine engine of the type including a plurality of radially extending blades rotatably disposed within a relatively stationary blade casing, a method of controlling an airflow to the casing to control the clearance between the blades and the casing, comprising the steps of:

(a) developing a first signal representative of the actual temperature of said casing;

(b) developing a second signal representative of the gas temperature within said casing and proximate to said blades;

(c) developing a third signal representative of the rotational speed of said blades;

(d) providing a schedule for receiving said second and third signals and developing a schedule output signal representative of a reference casing temperature at which a predetermined clearance is provided;

(e) coupling said second and third signals to said schedule and developing said schedule output signal;

(f) comparing said first signal and said schedule output signal and developing a clearance control signal representative of the difference therebetween; and (g) coupling said clearance control signal to a clearance control valve for controlling said airflow to said casing.

* * * * *